United States Patent [19]

Zysset

[11] Patent Number: 4,596,342

[45] Date of Patent: Jun. 24, 1986

[54] RIVET HOLES FOR EASY OPENING CONTAINERS

[75] Inventor: Edgar H. Zysset, St. Cloud, Fla.

[73] Assignee: Automated Container Corporation, Orlando, Fla.

[21] Appl. No.: 756,582

[22] Filed: Jul. 19, 1985

Related U.S. Application Data

[63] Continuation-in-part of Ser. No. 592,831, Mar. 23, 1985, Pat. No. 4,535,909.

[51] Int. Cl.[4] ..... B65D 17/34

[52] U.S. Cl. ..... 220/273; 413/14

[58] Field of Search ..... 220/270, 269, 273; 413/12, 14

[56] References Cited

U.S. PATENT DOCUMENTS

| | | | |
|---|---|---|---|
| 3,606,076 | 9/1971 | Hanke et al. | 220/273 |
| 3,857,166 | 12/1974 | Gaillard | 220/273 |
| 4,394,927 | 7/1983 | Zysset | 220/273 |

*Primary Examiner*—George T. Hall

*Attorney, Agent, or Firm*—Duckworth, Allen, Dyer & Pettis

[57] ABSTRACT

Disclosed are easy open containers using pull tabs having rivet holes with not less than eight, nor more than ten sides. A point between any two flats of the rivet hole is aligned with the pull tab nose. The disclosed rivet holes provide good locking characteristics.

12 Claims, 6 Drawing Figures

RIVET HOLES FOR EASY OPENING CONTAINERS

This application is a continuation-in-part of application Ser. No. 592,831 filed Mar. 23, 1985, now U.S. Pat. No. 4,535,909.

BACKGROUND OF THE INVENTION

1. Field of the Invention

The present invention relates to containers, particularly containers for foodstuffs. More specifically, the present invention is directed to a pull tab system of the easy open type, and to rivet hole arrangements for fixing easy open pull tabs to ends for containers.

2. Description of the Prior Art

There are a wide variety of easy-open pull tab configurations known in the prior art. Many of these designs and configurations are adapted for a specific use, or in conjunction with a specific metal gauge. Generally, however, there are two types of easy open pull tabs, which can be categorized by the manner in which each functions.

The first category includes those easy open pull tabs designed with a solid, attached rivet hole panel so as to fracture a vent score (commonly referred to as a "moustache", because of its shape) in order to create a fulcrum point for the tab to turn as it is lifted above the plane of the end panel. The nose then pierces the score line of the end panel for easy removal.

The second category of easy open pull tab systems are designed with a rivet hole panel independent of the tab body on three sides, but attached to the side opposed to the tab nose. The attached side becomes the fulcrum point between the tab body and the rivet hole.

Typically, pull tab systems are fabricated from flat metal stock using conventional metal stamping and forming techniques. Because large quantities of the pull tabs must be manufactured at one time, it is customary to stamp the tabs in flat strips, permitting the tabs to remain attached to the strip via so called "carrier lugs", which are simply portions of the metal which are not removed until near the end of the fabrication sequence. Heretofore, carrier lugs have been positioned at both ends of the pull tab configuration, usually at the nose portion and along both sides; in some cases, prior art easy open pull tabs have been constructed without carrier lugs being located along the pull ring portion, in order to avoid any sharp edges which might cause injury to the consumer while the pull tab ring is being used for opening.

Prior art patents which generally describe easy open pull tab arrangements for methods for manufacturing include the following: U.S. Pat. Nos. 3,850,124 to Brown; 4,026,226 to Hahn, et al.; 4,130,074 to Cudzik; 4,042,144 to Henning et al; and 4,394,927 to Zyssett.

Round square and hexagonal rivet holes have been used in easy open container constructions, with the hexagonal configuration being used to obtain unidirectional locking of the pull tab.

SUMMARY OF THE INVENTION

The present invention is directed to a rivet hole arrangement for easy open pull tabs.

In accordance with the preferred embodiment of the present invention, a rivet hole is used in the pull tab which has not less than eight, nor more than ten sides. Preferably, the hole is an octagon oriented with a point between two of the flat side is directed toward the tip of the tab.

In accordance with the method of making the present invention, the easy open pull tab is fabricated from a sheet of flat metal stock, with the octagonal hole fabricated in the flat stock.

DETAILED DESCRIPTION OF THE PREFERRED EMBODIMENT

Figure 1:
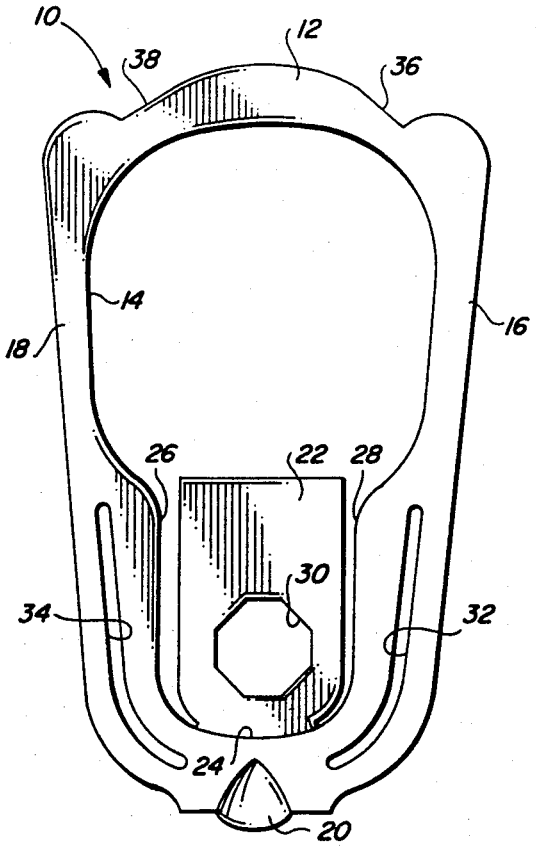
FIG. 1 is a top plan view of an easy open pull tab in accordance with the present invention.
Figure 2:
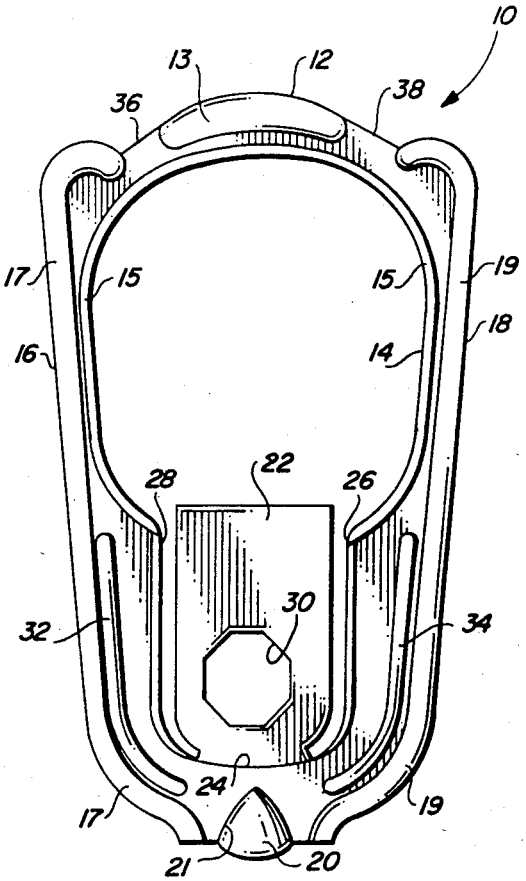
FIG. 2 is a bottom view of the pull tab of FIG. 1.

Referring first to FIGS. 1 and 2, an easy open pull tab construction in accordance with the present invention is referred to generally by the reference numeral 10. As earlier described, the pull tab is fabricated from a flat sheet of metal stock by conventional stamping and metal forming techniques.

The pull tab 10 includes a pull ring 12 defining an inner, generally annular opening 14 and with a pair of elongated beams 16, 18 formed continuously with the pull ring 12 and extending forward to a nose portion 20. As is more fully described with reference to FIGS. 3 and 4 below, the nose portion 20 defines a forward extremity adapted to engage and sever a conventional score line in an end panel of a container.

Figure 4:
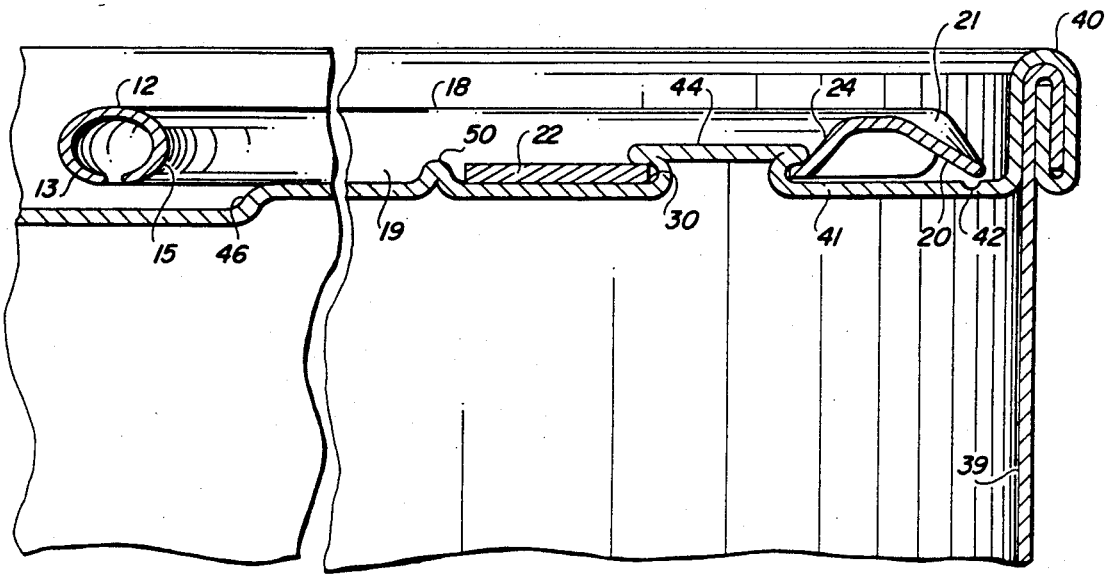
FIG. 4 is a cross sectional elevation of the container -pull tab combination of FIG. 3, taken along the line 4—4.

The pull tab 10 further includes a flat strip 22 extending rearwardly from the nose portion 20 and indented downwardly from the general plane of the tab 10 along a break line 24; the configuration of this break line is best seen by specific reference to FIG. 4. The flat strip 22 is defined by a pair of slots 26, 28, each slot extending between the strip 22 and the adjacent one of the beams 16, 18. Each slot 26, 28 extends in a forward direction toward the nose portion 20, but angles inwardly at the break line 24. The flat strip 22 further includes an eight-sided hole 30 adapted to receive a fastener, such as a rivet 44 (note FIG. 4). Preferably, all of the eight sides are of equal length, so that the rivet hole 30 defines an octagon.

It has been found that the octagonal hole 30 provides substantially better locking characteristics than previously achieved with a six-sided (hexagonal) hole. This result is obtained because the rivet 44 (FIG. 4) expands sufficiently to lock against the flats of the hole 30; however, conventional rivet metal will not expand sufficiently to lock properly in a six-sided rivet hole.

A pair of strengthening indentations 32, 34 extend along each of the respective beams 16, 18 and angle inwardly toward the nose portion at the forward extremity of each indentation (note FIG. 1).

As is further shown in FIGS. 1 and 2, the pull tab 10 includes a pair of flat "cutouts" 36, 38 which cutouts indicate the location of the only two carrier lugs associated with the pull tab 10 during the manufacturing thereof. The use of these carrier lugs is more fully described below with reference to FIG. 5.

Referring now to FIG. 2, it is seen that the pull ring 12 is provided with a peripheral curl 13 formed by rolling the flat stock inwardly and underneath. Similarly, the inner periphery 14 of the pull ring 12 along the beams 16, 18 is also provided with a peripheral curl 15 formed in a similar manner. The peripheral curls 13 and 15 abut each other so as to provide a surface which will not cut or injure the consumer during the opening operation.

In a similar manner, each of the beams, 16, 18 is provided with a corresponding outer peripheral curl 17, 19. Each of the peripheral curls 17, 19 extends continuously from the corresponding carrier lug cutout 36, 38 forward to a point adjacent the nose portion 20. In this way, the peripheral and continuous beam curls 17, 19 substantially strengthen the overall construction of the pull tab 10, than is otherwise realized when the carrier lug cutouts are located along each of the beams, such as has been used in the prior art.

As is further shown in FIGS. 2 and 4, the nose portion 20 is indented downwardly with respect to the plane of the stock material from which the tab 10 is fabricated, the periphery of the indentation being defined by reference numeral 21.

Figure 3:
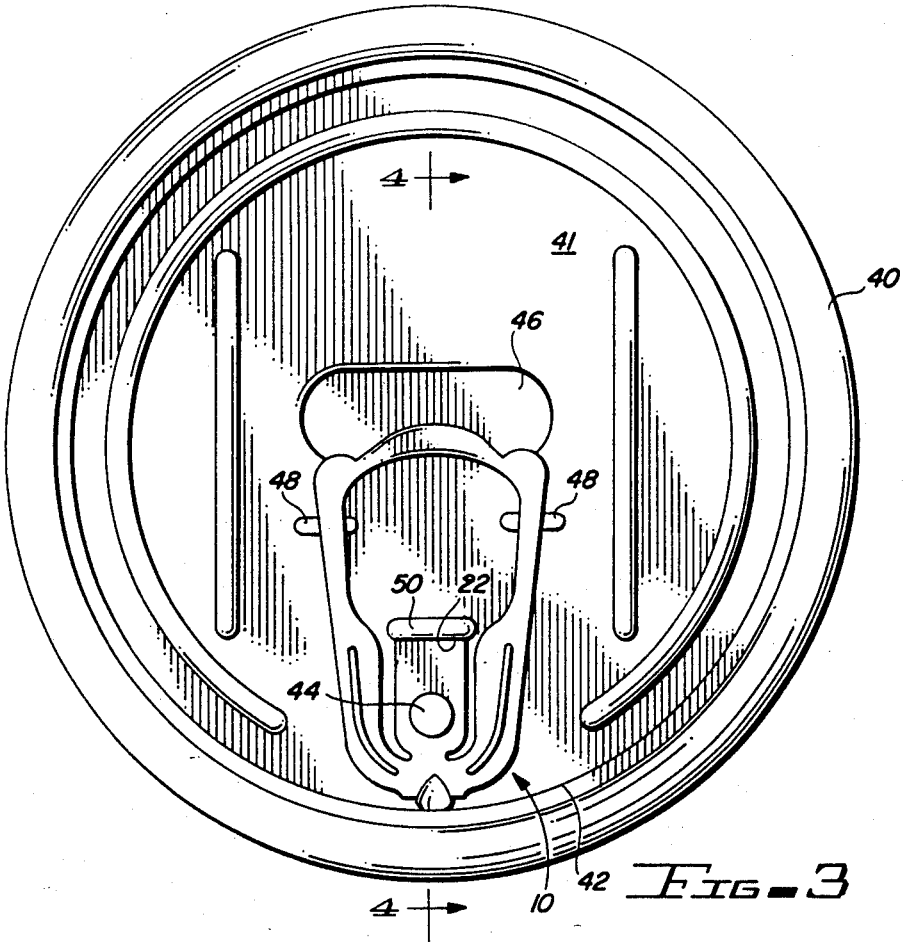
FIG. 3 is a top plan view of a pull tab - end panel constructed in accordance with the present invention.

Use of the pull tab 10 with a container and the associated end is shown in FIGS. 3 and 4 and described with reference thereto.

Noting FIG. 4, numeral 39 refers to the sidewall of the container in which an end panel is attached; the end panel is defined by a peripheral curl 40 attached to the sidewall 39 of the container, and a generally flat field 41 to which the easy open pull tab 10 is attached via a rivet 44 extending through the octagonal rivet hole 30. The nose portion 20 of the pull tab 10 is positioned over and immediately adjacent to a continuous weakened score line 42 around the outside periphery of the flat field 41 of the end panel.

The end panel 40, 41 includes an indentation 46 extending downwardly away from the pull ring 12 underneath the peripheral curls 13, 15 to permit a consumer to extend a fingernail or other object underneath to begin the pull tab removal procedure. As is shown in FIG. 3, the end panel further includes a pair of upward indentations 48 designed to support the opposing beams 16, 18. The end panel further includes an upwardly extending crimped ridge 50 parallel with the rearward end of the flat strip 22 of the pull tab 10 and immediately adjacent thereto, to limit axial rotation of the pull tab 10 about the rivet 44.

The method of manufacturing the easy opening pull tab 10 of the present invention will now be described with reference to FIG. 5, which shows four of the fabrication steps.

Figure 5:
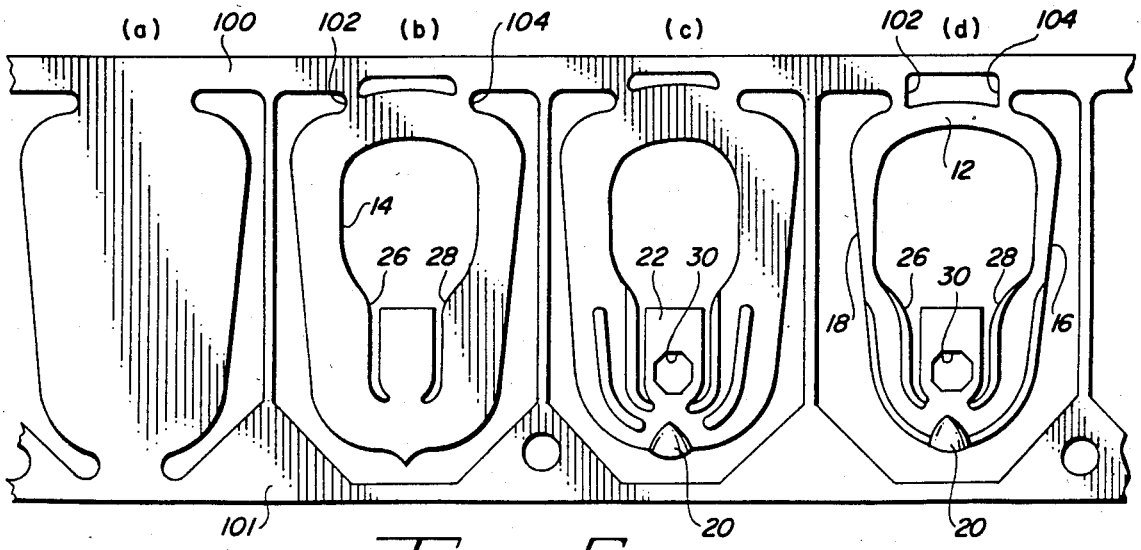
FIG. 5 is a top plan view illustrating one step in the fabrication of easy open pull tabs in accordance with the present invention.

As is shown in FIG. 5, there is provided a flat metal stock material subjected to conventional stamping operations, and including a pair of carrier rails 100, 101 common to all of the pull tabs being fabricated. A pair of carrier lugs 102, 104 corresponding to the flat cutouts 38, 36 respectively are provided (note position (b) in FIG. 5). As an initial stamping operation, the annular hole 14 is defined, together with the slots 26, 28. In another step, the flat strip 22 is formed together with the octagonal rivet hole 30, and the downwardly extending portion of the nose 20 is formed (note step (c) in FIG. 5). Thereafter, as is shown in step (d), the peripheral curls are formed. It will be understood by those skilled in the art that the carrier lugs 102, 104 provide the only contact with the upper carrier rail 100, thus permitting the peripheral curls 17, 19 associated with the beams 16, 18 to be formed continuously from the pull ring 12 to the nose portion 20, to provide for a pull tab having desirable strength characteristics along the continuous length of each of the beams 16, 18.

As previously noted, the octagonal hole 30 provides substantially better locking characteristics along the facets of the hole than has previously been achieved through the use of six sided rivet holes. A hole with as many as ten sides (a decagon) should provide the same characteristics as an octagon as well, but rivet holes of a greater number of sides (11 or more) will have characteristics so much like a round hole that sufficient locking will not take place.

Figure 6:
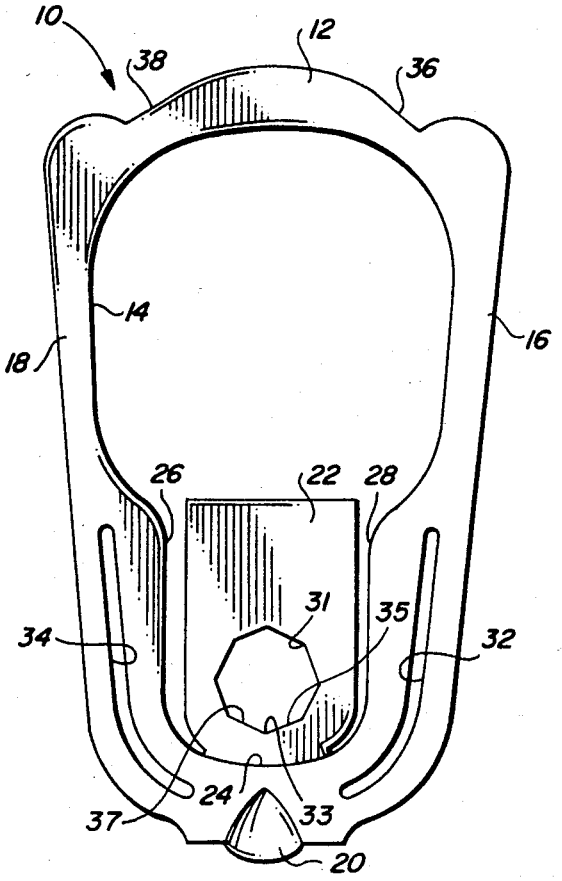
FIG. 6 is a top plan view illustrating an alternative rivet hole arrangement according to the present invention.

An alternative embodiment of the rivet hole arrangement is shown in FIG. 6. In FIG. 6, all like reference numerals refer to the same structural element as in FIG. 1.

In FIG. 6, rivet hole 31 is also octagonal, with one of the points 33 between two of the flats 35, 37 running parallel with the fulcrum line of the tab 10 when the container is being opened; that is, the point 33 extends in the same direction as the nose 20.

During manufacture of the pull tab-end combination, the octagonal hole 30 or 31 (FIGS. 1 or 6) is stamped into the flat strip 22. The rivet 44 is formed in the end panel, the tab 10 is placed onto the end with the rivet 44 extending through the hole 30 or 31, and the rivet 44 is crimped. Before crimping, the cylindrical rivet 44 has a diameter slightly less than the shortest dimension between any two flats of the rivet hole 30 or 31, so that the rivet extends easily into the rivet hole. After crimping, the metal of the rivet 44 expands outwardly and engages the flat sides of the octagonal hole 30 or 31. The locking characteristics using the octagonal 30 or 31 are substantially improved with respect to previously used hexagonal rivet holes.

Thus, rivet holes using the configurations described above and shown in the drawing achieve better locking characteristics than have previously been obtained with round, square or hexagonal rivet holes.

I claim:

1. A container having a pull tab for the easy opening thereof, said container comprising:

a container having an end with a weakened score line the severing of which permits access to said container;

a fastener joined to said container end and spaced from said score line;

a pull tab joined to said fastener and having a pull ring extending from said fastener in a direction away from said score line and a nose portion extending adjacent said score line, said pull tab having a rivet hole therein; and means for strengthening each of said beams coontinuously along the length from said pull ring to said nose portion.

a rivet extending through said rivet hole; and wherein said rivet hole has not less than eight, nor more than ten, sides.

2. The container recited in claim 1 wherein said pull tab further comprises a flat strip extending from said nose portion toward said pull ring, said flat strip being disposed inwardly from said pull tab toward said end, with said rivet hole extending through said flat strip.

3. The container recited in claim 2 wherein said pull tab further includes two slots, each slot extending along said flat strip.

4. The container recited in claim 1 wherein said rotation limiting means comprises said fastener extending an octagonal hole in said pull tab and crimped thereto.

5. The container recited in claim 1 wherein said rivet hole includes a point between two flat sides thereof, said point aligned with said nose portion.

6. A container having an easy opening pull tab, comprising:

a container with an end having a weakened score line the severing of which permits access to the container;

a fastener joined to said container end and spaced from said score lines;

a pull tab joined to said fastener and having a pull ring extending from said fastener in a direction away from said score line, and a nose portion extending adjacent to said score line to permit the severing of said score line upon pulling of said pull ring in a direction away from said container end; and means for limiting axial rotation of said pull tab a said fastener, said axial rotation limiting means including an eight-sided hole in said pull tab into which said fastener is locked.

7. The container recited in claim 6 wherein said eight-sided hole includes a point between two flats sides thereof, said point aligned with said nose portion.

8. An easy open pull tab container comprising:

a container end having means permitting the severing along a portion thereof;

a fastener with said container end;

a pull tab joined to said fastener, said pull tab having a hole therein for engaging said fastener, said hole having at least eight sides, and not more than ten sides, said sides of said hole contacting and locking with said fastener.

9. The easy open pull tab container recited in claim 8 wherein said hole is octagonal.

10. The easy open pull tab container recited in claim 8 wherein a point between two sides thereof extends in a desired direction toward said severing means.

11. A method for forming a container having an easy open pull tab, said method comprising the steps of:

providing a container with an end having a wea score line the severing of which permits access to said container;

forming a generally cylindrical rivet in said end;

providing a pull tab having a pull ring and a nose portion, with an octagonal hole in said pull tab, said hole having a dimension between opposing tabs which is slightly greater than the diameter of said rivet;

fitting said pull tab on said end with rivet extending said rivet hole; and crimping said rivet in said hole, so that said rivet expands and locks along said flats of said octagonal hole.

12. The method recited in claim 11 wherein said octagonal hole is formed in said pull tab with a point between two flats thereof aligned with said nose portion.

* * * * *